US012808206B2

(12) United States Patent
Gasperich et al.

(10) Patent No.: US 12,808,206 B2
(45) Date of Patent: Nov. 24, 2026

(54) EXTENDABLE FLOORING MODULE

(71) Applicant: Connor Sports Flooring, LLC, Salt Lake City, UT (US)

(72) Inventors: Jason Gasperich, Salt Lake City, UT (US); Roch Vighi, Salt Lake City, UT (US)

(73) Assignee: Connor Sports Flooring, LLC, Salt Lake City, UT (US)

( * ) Notice: Subject to any disclaimer, the term of this patent is extended or adjusted under 35 U.S.C. 154(b) by 0 days.

(21) Appl. No.: 17/582,817

(22) Filed: Jan. 24, 2022

(65) Prior Publication Data

US 2022/0235542 A1 Jul. 28, 2022

Related U.S. Application Data

(60) Provisional application No. 63/140,507, filed on Jan. 22, 2021.

(51) Int. Cl.
*E04B 1/34* (2006.01)
*E04F 15/22* (2006.01)

(52) U.S. Cl.
CPC ..... *E04F 15/225* (2013.01)

(58) Field of Classification Search
CPC . E04F 15/225; E04F 15/22; E04F 2201/0594; E04F 2015/0205; E04C 2/405
See application file for complete search history.

(56) References Cited

U.S. PATENT DOCUMENTS 2,534,852 A 12/1950 Butts
3,183,626 A 5/1965 Schmitt
3,413,771 A 12/1968 Dudley
4,821,481 A * 4/1989 Woodman ..... E04C 2/422 411/908
4,912,887 A 4/1990 Sullivan
5,388,380 A 2/1995 Niese
(Continued)

FOREIGN PATENT DOCUMENTS

CN 208152472 U 11/2018
EP 0686738 A1 12/1995
(Continued)

OTHER PUBLICATIONS

International Search Report issued Apr. 29, 2022, in International Application No. PCT/US2022/013534 filed Jan. 24, 2022, (4 pages).

*Primary Examiner* — Brian E Glessner

(74) *Attorney, Agent, or Firm* — Thorpe North & Western, LLP; Garron M. Hobson; Kurt H. Hendricks

(57) ABSTRACT

An extendable flooring module is disclosed. The extendable flooring module comprising at least two sleeper components, wherein a first sleeper component is positioned parallel to a second sleeper component, at least one cross-arm member having a first end and a second end, and a pivot system comprising fasteners that couple the first end of the cross-arm member to a portion of the first sleeper component and couple the second end of the cross-arm member to a portion of the second sleeper component. The fasteners allow the cross-arm member to pivot relative to the first and second sleeper components and the cross-arm member to span a distance between the first and second sleeper components when the extendable flooring module is placed in an extended position.

24 Claims, 8 Drawing Sheets

(56) References Cited

U.S. PATENT DOCUMENTS

| | | | | |
|---|---|---|---|---|
| 5,412,917 | A | 5/1995 | Shelton | |
| 6,122,873 | A | 9/2000 | Randjelovic | |
| 6,363,675 | B1 | 4/2002 | Shelton | |
| 6,367,217 | B1 | 4/2002 | Niese et al. | |
| 6,418,677 | B1 | 7/2002 | Goto | |
| 6,557,314 | B2 * | 5/2003 | Shelton | E04F 15/225 52/480 |
| 6,883,287 | B2 | 4/2005 | Niese et al. | |
| 6,928,683 | B1 * | 8/2005 | Hanson | E04B 1/344 296/61 |
| 7,243,470 | B2 | 7/2007 | Chae | |
| 8,161,690 | B1 | 4/2012 | Borne et al. | |
| 9,469,991 | B2 * | 10/2016 | Milanowski | E04C 2/405 |
| 10,329,777 | B2 | 6/2019 | Hering et al. | |
| 10,414,415 | B1 | 9/2019 | Ishida et al. | |
| 10,443,249 | B2 | 10/2019 | Delfeld | |
| 2002/0189184 | A1 | 12/2002 | Shelton | |

FOREIGN PATENT DOCUMENTS

| | | | |
|---|---|---|---|
| JP | 07-036876 | U | 7/1995 |
| WO | WO 9214522 | A1 | 9/1992 |

* cited by examiner

EXTENDABLE FLOORING MODULE

PRIORITY

This application claims priority to U.S. Provisional Patent Application 63/140,507 filed on Jan. 22, 2021 entitled "Extendable Flooring Module" which is incorporated herein by reference in its entirety.

FIELD OF THE TECHNOLOGY

The present technology relates to flooring and more particularly to extendable subflooring modules, systems, and methods for manufacture and installing subflooring.

BACKGROUND OF THE TECHNOLOGY AND RELATED ART

Solid wood flooring is used in various applications including home, commercial, and sport flooring surfaces. In an athletic flooring application, solid wood floors provide a playing surface with desirable ball bounce characteristics. Conventional solid wood flooring surfaces used in athletic flooring applications utilize continuous solid wood slats or planks placed on sub-floor systems. A sub-floor is used to provide ventilation and minimize problems associated with expansion and contraction of the overlying hardwood surface.

A sub-floor panel system can be used to efficiently install a sub-floor for use with an overlying hardwood surface. A sub-floor panel can comprise a plurality of components which may be interconnected with additional sub-floor panels to form an integrated sub-floor. For example, a sub-floor panel can include a number of sleepers, such as softwood runners, and cross-arms or brackets connected to the sleepers, forming a fixed panel which can provide a base for an overlaying flooring surface. However, because the components of the sub-floor panel are fixed, there exists a large amount of empty space between the components. For example, an amount of space between sleepers can be several inches (e.g., five inches or more). This empty space between the fixed components of the sub-floor panel results in, among other things, inefficiencies associated with shipping non-occupied space in a shipping container containing the sub-floor panel. It is therefore desirable to have an extendable flooring module which can be placed in a collapsed position and later placed in an extended position to allow installation of the extendable flooring module.

SUMMARY

An extendable flooring module is disclosed. In one example configuration the extendable flooring module includes at least two sleeper components, wherein a first sleeper component is positioned parallel to a second sleeper component, at least one cross-arm member having a first end and a second end, and a pivot system comprising fasteners that couple the first end of the cross-arm member to a portion of the first sleeper component and couple the second end of the cross-arm member to a portion of the second sleeper component. The fasteners allow the cross-arm member to pivot relative to the first and second sleeper components and the cross-arm member to span a distance between the first and second sleeper components when the extendable flooring module is placed in an extended position.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology, they are therefore not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DETAILED DESCRIPTION

Figure 1:
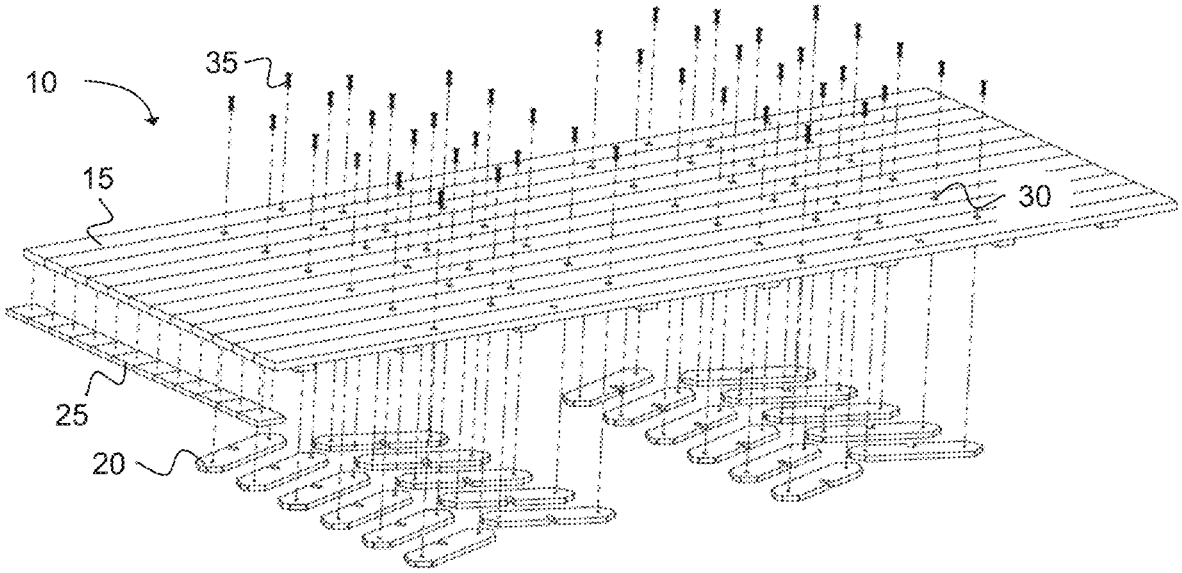
FIG. 1 is an exploded diagram of the extendable flooring module in accordance with one aspect of the technology.

The following detailed description of exemplary aspects of the technology makes reference to the accompanying drawings, which form a part hereof and in which are shown, by way of illustration, exemplary aspects in which the technology may be practiced. While these exemplary aspects are described in sufficient detail to enable those skilled in the art to practice the technology, it should be understood that other aspects may be realized and that various changes to the technology may be made without departing from the spirit and scope of the present technology. Thus, the following more detailed description of the aspects of the present technology is not intended to limit the scope of the technology, as claimed, but is presented for purposes of illustration only and not limitation to describe the features and characteristics of the present technology and to sufficiently enable one skilled in the art to practice the technology. Accordingly, the scope of the present technology is to be defined solely by the appended claims.

As used in this specification and the appended claims, the singular forms "a," "an" and "the" include plural referents unless the context clearly dictates otherwise. Thus, for example, reference to "a line" includes a plurality of such lines. In this disclosure, "comprises," "comprising," "containing" and "having" and the like can have the meaning ascribed to them in U.S. patent law and can mean "includes," "including," and the like, and are generally interpreted to be open ended terms.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in any manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about".

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Reference throughout this specification to "an example" means that a particular feature, structure, or characteristic described in connection with the example is included in at least one embodiment. Thus, appearances of the phrase "in an example" in various places throughout this specification are not necessarily all referring to the same embodiment.

It should be understood that the aspects of the technology discussed herein are contemplated for use with any type of flooring system. For purposes of illustrating the various aspects of the methods and systems claimed herein, the discussion below will be primarily directed to describing exemplary embodiments directed to sports floors. It should be noted, however, that the elements and principles discussed herein are applicable to other applications. It is also noted that discussion of methods and systems herein can be interchangeable with respect to specific aspects. In other words, specific discussion of one method or system (or components thereof) herein is equally applicable to other aspects as they relate to the system or method, and vice versa. The following detailed description and exemplary aspects of the technology will be best understood by reference to the accompanying drawings, wherein the elements and features of the technology are designated by numerals throughout.

The present technology describes an extendable flooring module having two or more sleeper components, one or more cross-arm members, and a pivot system that allows the extendable flooring module to be placed in either of a collapsed position and an extended position. Placing the extendable flooring module in a collapsed position can include pushing the sleeper components in an inward direction causing the cross-arm members to pivot relative to the sleeper components and fold underneath the sleeper components, thereby closing a space or gap between the sleeper components so that the sleeper components are substantially adjacent to one another. Placing the extendable flooring module in an extended position can include pulling the sleeper components in an outward direction causing the cross-arm members to pivot relative to the sleeper components and extend from the sleeper components, thereby creating a space or gap between the sleeper components which is spanned by the cross-arm members. The pivot system can include fasteners used to operably connect the ends of the cross-arm members to the sleeper components to allow the cross-arm members to pivot relative to the sleeper components.

A sleeper component can include an elongated slat, plank, or the like made of wood or another material on which an overlaying floor can be placed. A cross-arm member can include a brace, support, bracket, or the like made of wood, polymer or another material, and the cross-arm member can be pivotally coupled at one end to a first sleeper component, and pivotally coupled at the other end to a second sleeper component. Each sleeper component can include a plurality of resilient pads or cushions disposed on a bottom surface of the sleeper component to provide resiliency to a floor assembly. The resilient pads can have a height which is greater than a height of the cross-arm members in order to prevent contact of the cross-arm members with a ground surface.

Figure 2:
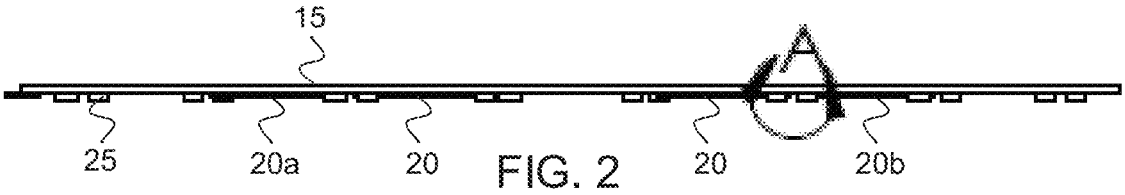
FIG. 2 is a side view of the extendable flooring module in FIG. 1.
Figure 3:
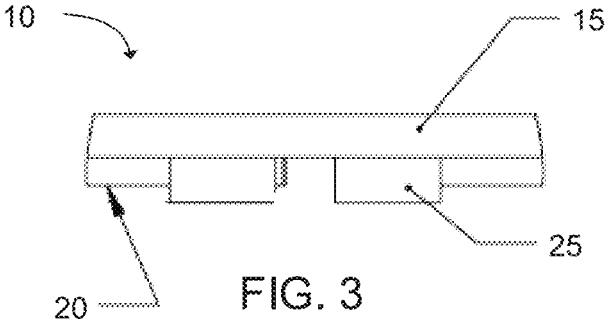
FIG. 3 is a detail view of the extendable flooring module in FIG. 2.

With specific reference now to FIGS. 1-3, an extendable flooring module 10 is shown which has components to allow the extendable flooring module 10 to be positioned in either of a collapsed position or an extended position. Placing the extendable flooring module 10 in the collapsed position provides benefits associated with transporting the extendable flooring module 10 and installing the extendable flooring module 10 on a ground surface or substrate. The extendable flooring module 10 can be placed in the extended position at install time, such that sleeper components 15 may be spaced a distance apart to allow an overlying floor (e.g., a hardwood floor or other flooring material) to be installed on top of the sleeper components 15. Further, the extendable flooring module 10 allows for coupling of adjoining extendable flooring modules 10 to form a subfloor layer which can be overlaid with a surface floor for athletics or any other desirable purpose. Illustratively, surface flooring strips (not shown) can then be placed over the subfloor layer comprising the extendable flooring modules 10, preferably in a direction substantially perpendicular to the sleeper components 15 of the extendable flooring modules 10.

The extendable flooring module 10 includes sleeper components 15 pivotally coupled to cross-bar members 20, and resilient pads 25. In one example, the extendable flooring module 10 includes at least two sleeper components 15 and at least one cross-arm member 20. Each sleeper component 15 is connected to one or more cross-arm members 20. As an example, two or more cross-arm members 20 can be used to operably connect a first sleeper component 15 to a second sleeper component 15. The cross-arm member 20 is pivotally coupled at one end to a portion of a first sleeper component 15, and at the other end to a portion of a second sleeper component 15. The extendable flooring module 10 includes a pivot system comprising fasteners 35 that couple a first end of the cross-arm member 20 to a portion of a first sleeper component 15 and couples a second end of the cross-arm member 20 to a portion of a second sleeper component 15. The sleeper components 15 contain holes 30 or openings that extend from a top surface to a bottom surface of the sleeper components 15. The holes 30 correspond to placement of the cross-arm members on the sleeper components 15, and the holes 30 accept the fasteners that couple the cross-arm members 20 to the sleeper components 15. The fasteners 35 allow the cross-arm member 20 to pivot relative to the first and second sleeper components 15 and the cross-arm member 20 to span a distance between the first and second sleeper components 15 when the extendable flooring module 10 is placed in an extended position. In one example, when in the expanded position, the cross-arm member 20 may by substantially perpendicular to the sleeper components 15 to which the cross-arm member 20 is coupled. When in the collapsed position, the cross-arm member 20 may be at an obtuse angle (e.g., 40°, 45°, or 50°) relative to the sleeper components 15 to which the cross-arm member 20 is coupled.

Figure 15:
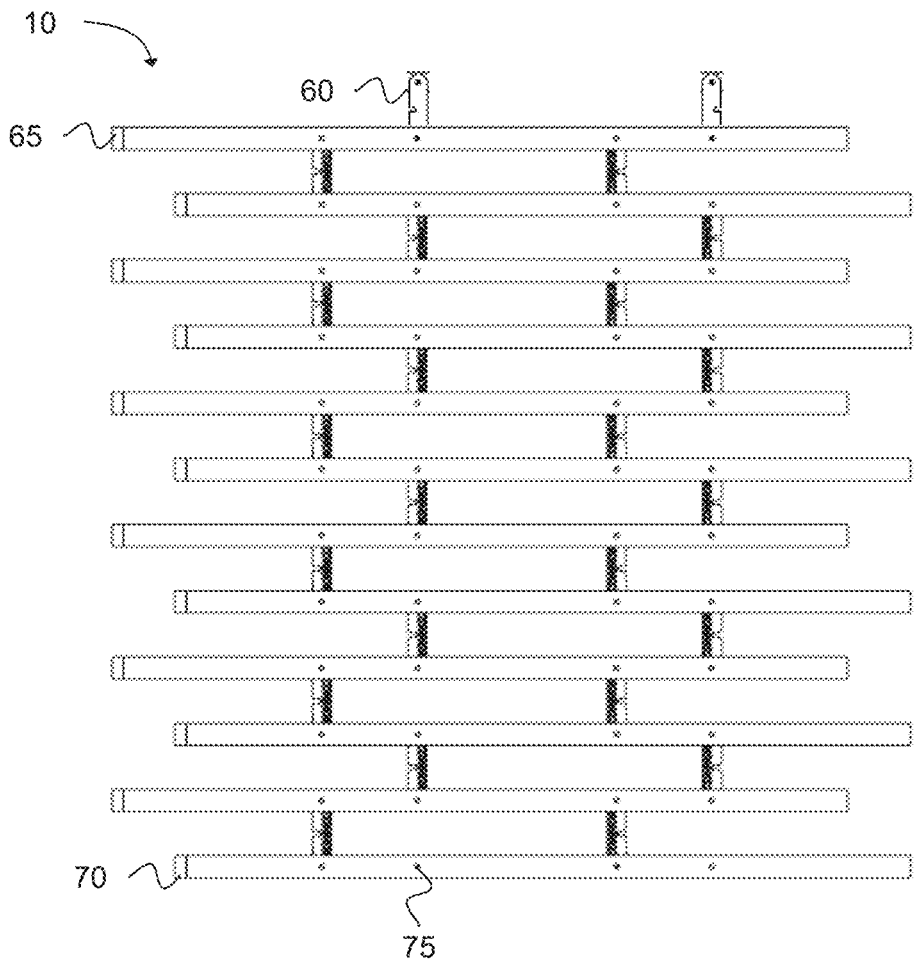
FIG. 15 is a top view of the extendable flooring module of FIG. 1 showing a connector cross-arm member that is available to be pivotally coupled with an adjacent extendable flooring module.

In one example, as shown in FIG. 15, the extendable flooring module 10 includes a connector cross-arm member 60 having a first end that is pivotally coupled to an end sleeper component 65 of the extendable flooring module 10, and an uncoupled second end that is available to be pivotally coupled with an adjacent extendable flooring module.

FIG. 2 is a side view of the extendable flooring module 10 and shows cross-arm members 20 and resilient pads 25 coupled to a bottom surface of the sleeper components 15 shown in FIG. 1. A first end of a cross-arm member 20 is disposed on a bottom surface of a first sleeper component, and a second end of the cross-arm member 20 is disposed on a bottom surface of a second sleeper component, which is adjacent to the first sleeper component. Disposition of the cross-arm members 20 on the sleeper components 15 may be determined by the number of cross-arm members 20 used to connect the second sleeper components 15. For example, as shown in FIG. 2, in the case that two cross-arm members 20*a-b* are used, one cross-arm member 20*a* may be disposed in a first half of the sleeper component 15, and the second cross-arm member 20*b* may be disposed in a second half of the sleeper component 15. The cross-arm members 20 can be spaced apart from one another on the sleeper component 15 to substantially maintain a right-angle distance of space between adjacent sleeper components. As will be appreciated, additional cross-arm members 20 can be used to operably couple adjacent sleeper components 15.

The resilient pads 25 are strategically disposed along the bottom surface of the sleeper components 15. The resilient pads 25 are capable of withstanding shock without permanent deformation or rupture and are made of generally compressible, moldable material. The resilient pads 25 can comprise urethane, re-bonded foam, open cell polyurethane, closed-cell polyethylene, or other material as desired. One such resilient pad is described in U.S. Pat. Application 2006/0260236 A1. In an alternative example, rather than employing a number of resilient pads 25, a resilient layer may be used and may be made up of a single strip of resilient pad material which extends along bottom surface sections of the sleeper members 15.

FIG. 3 is a detailed view of FIG. 2 showing the sleeper component 15, cross-arm members 20, and resilient pads 25. The resilient pads 25 disposed along a bottom surface of the sleeper components 15 have a height which is greater than that of the cross-arm members 20 to prevent the cross-arm members 20 from coming in contact with a ground surface.

Figure 4:
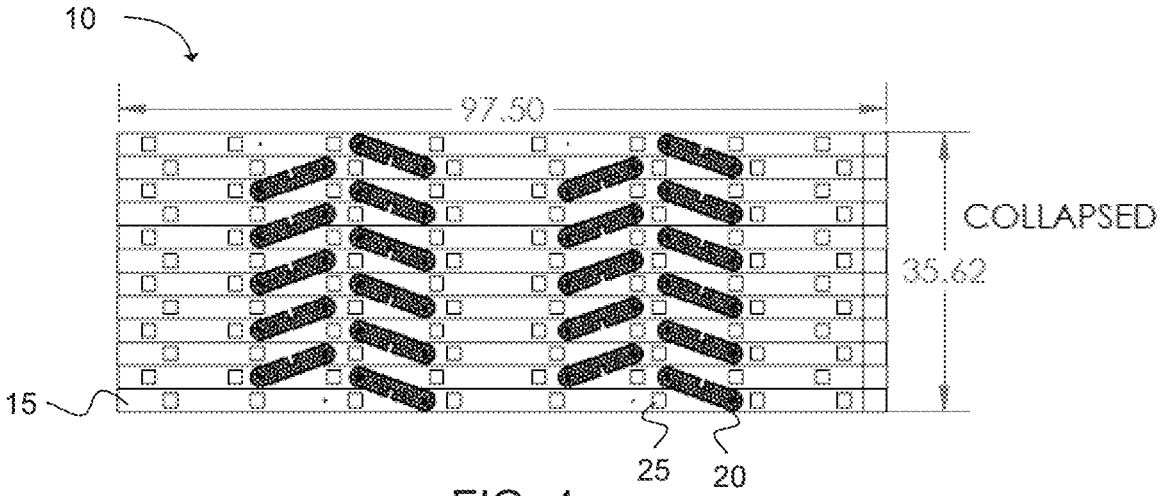
FIG. 4 is a bottom view of the extendable flooring module of FIG. 1 in a collapsed position.
Figure 5:
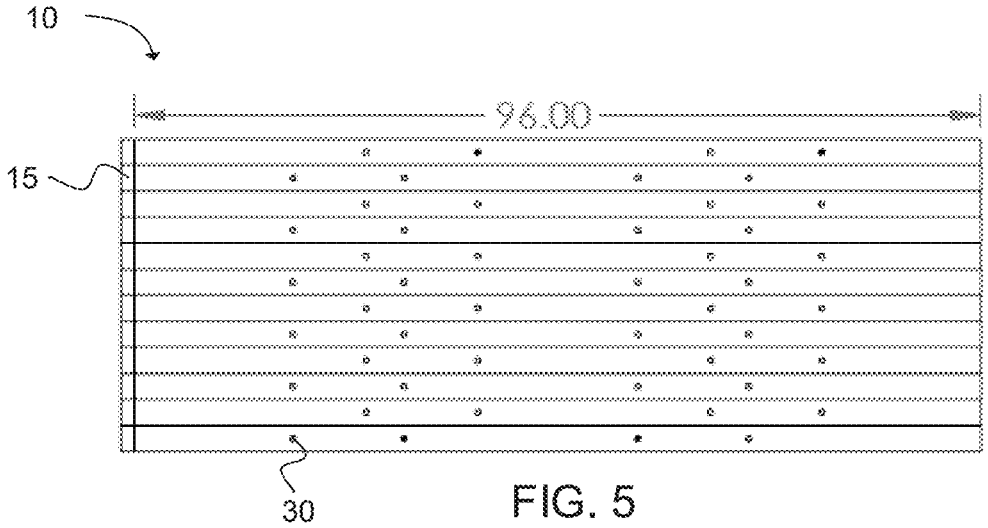
FIG. 5 is a top view of the extendable flooring module of FIG. 1 in the collapsed position.

FIGS. 4-5 illustrate the extendable flooring module 10 of FIG. 1 in a collapsed position. The extendable flooring module 10 is collapsible to reduce a length or width of the extendable flooring module 10, which provides benefits associated with transporting the extendable flooring module 10. As one example, in a collapsed position, a greater number of extendable flooring modules 10 can be loaded into a shipping container as compared to a number of a sub-floor modules in a fixed configuration. As another example, an extendable flooring module 10 in a collapsed position can be more easily maneuvered through some openings, such as doorways. The extendable flooring module 10 is expandable to increase a length or width of the extendable flooring module 10 and to create a space or channel between the sleeper components 15 having a distance that is determined by the cross-arm members 20. For example, in an expanded position, the cross-arm members 20 may define a space between the sleeper components 15 that adequately provides air circulation between a ground surface and overlaying floor without negatively impacting foundational support provided by the sleeper components 15 for the overlaying floor.

FIG. 4 is a bottom view of the extendable flooring module 10 in the collapsed position showing an orientation of cross-arm members 20 when the extendable flooring module 10 is in the collapsed position. As shown, the cross-arm members 20 can be disposed so as to be vertically aligned along the bottom surface of the sleeper components 15, where each cross-arm member 20 is oriented at an oblique angle to operably connect a first and second sleeper component 15. FIG. 4 shows that the resilient pads 25 can be disposed on the bottom surface of the sleeper components 15. FIG. 4 further shows that the resilient pads 25 can be used to support the distal ends of the sleeper components 15, and support the portions of the sleeper components 15 where the cross-arm members 20 are coupled to prevent the cross-arm members 20 from coming in contact with a ground surface.

Figure 14A:
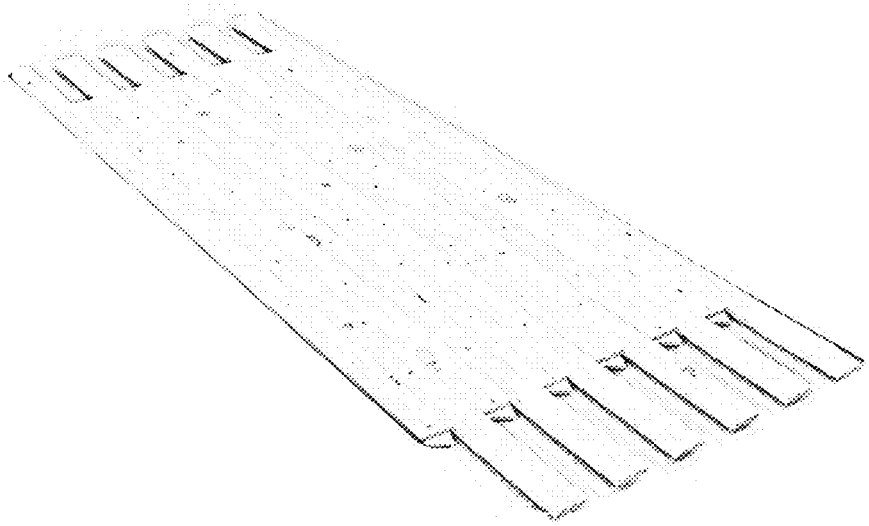
FIGS. 14A-C illustrate a method of installation of an extendable flooring module in accordance with one aspect of the technology.

FIG. 5 is a top view of the extendable flooring module 10 in the collapsed position showing that a distance between adjacent sleeper components 15 is substantially closed. Also shown are holes 30 in the sleeper components 15 disposed in locations that correspond to placement of cross-arm members 20. The holes 30 are designed to accept the fasteners 30 used to couple the cross-arm members 20 to the sleeper components 15. In one example configuration, the distal ends of the sleeper components 15 are substantially aligned with one another when the extendable flooring module 10 is in the collapsed position, as shown in FIG. 5. In another example configuration, the distal ends of the sleeper components 15 are staggered from one another (as shown in FIG. 14A) when the extendable flooring module 10 is in the collapsed position.

Figure 6:
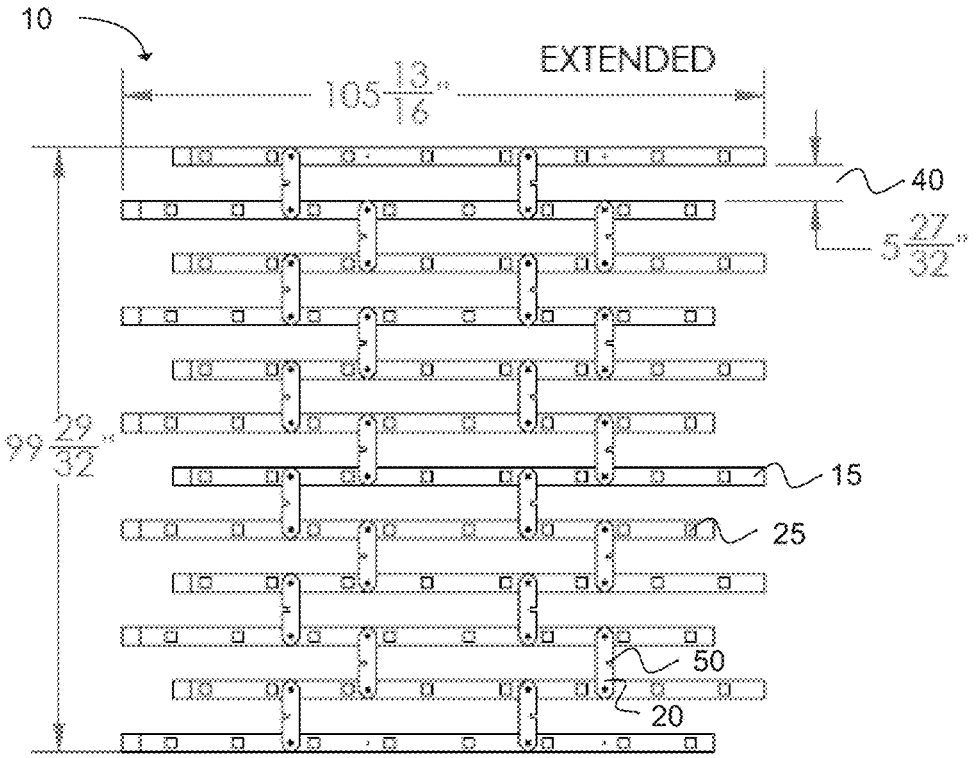
FIG. 6 is a bottom view of the extendable flooring module of FIG. 1 in an extended position.
Figure 7:
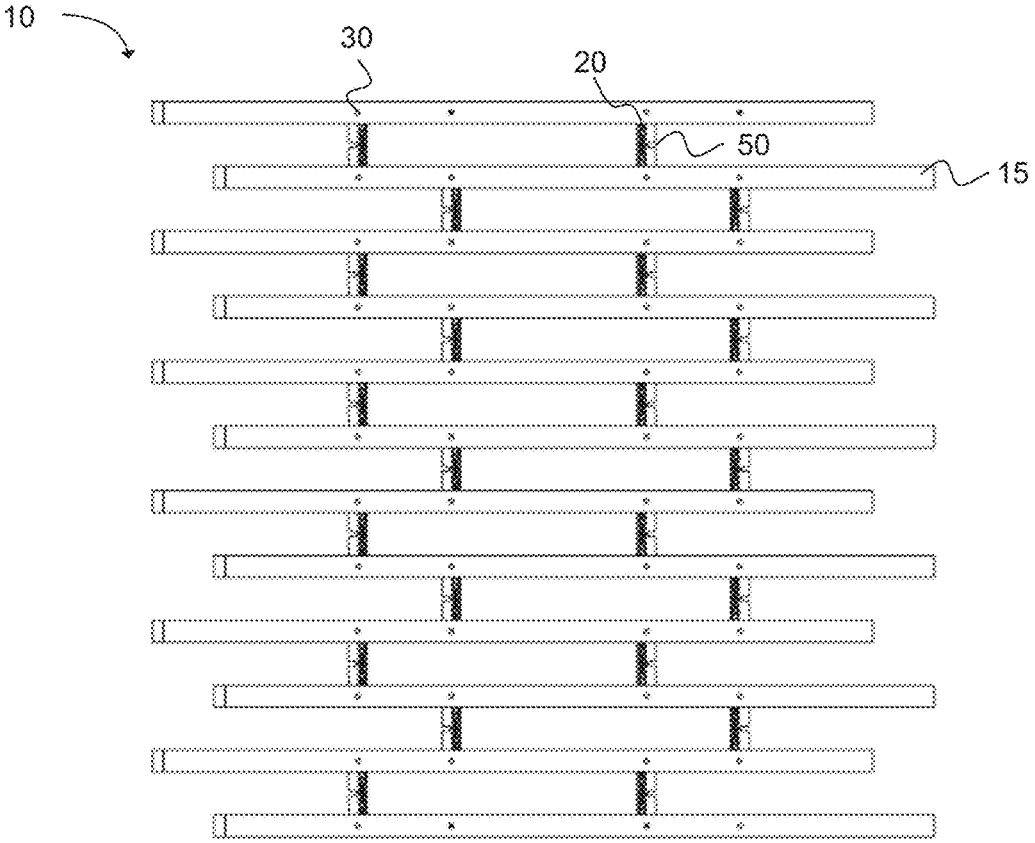
FIG. 7 is a top view of the extendable flooring module of FIG. 1 in the extended position.

FIGS. 6-7 illustrate the extendable flooring module 10 of FIG. 1 in an expanded position. The expanded position of the extendable flooring module 10 is an installation configuration of the extendable flooring module 10 having a distance or space 40 between sleeper components 15. Illustratively, an extendable flooring module 10 can be positioned in an installation location on a ground surface and the extendable flooring module 10 can be expanded to expose a space 40 between the sleeper components 15. The same procedure can be repeated with additional extendable flooring modules 10, which are placed adjacent to one another to form a subfloor layer.

When placed in the expanded position, the fasteners 35 of the pivot system allow the cross-arm members 20 to pivot relative to the sleeper components 15, such that the cross-arm members 20 span a distance between adjacent sleeper components 15 and define a space between the adjacent sleeper components 15 to allow air circulation between a ground surface and an overlaying floor. As can be seen in FIGS. 6-7, the cross-arm members 20 are substantially perpendicular to the sleeper components 15 when the extendable flooring module 10 is in the expanded position, and the sleeper components 15 and cross-arm members 20 define the space 40 between adjacent sleeper components 15. As a non-limiting example, the defined space can be approximately four inches wide and eight feet long. Alternatively, rather than fully extending the sleeper components 15, the cross-arm members 20 can be partially extended, such that the cross-arm members 20 are at an oblique angle relative to the sleeper components 15 (as opposed to a right angle created by fully extending the cross-arm members 20), thereby defining a smaller space 40 between adjacent sleeper components 15 as compared to fully extending the cross-arm members 20. Accordingly, as used herein, the extended position can refer to both fully extended cross-arm members 20 and partially extended cross-arm members 20.

Figure 14B:
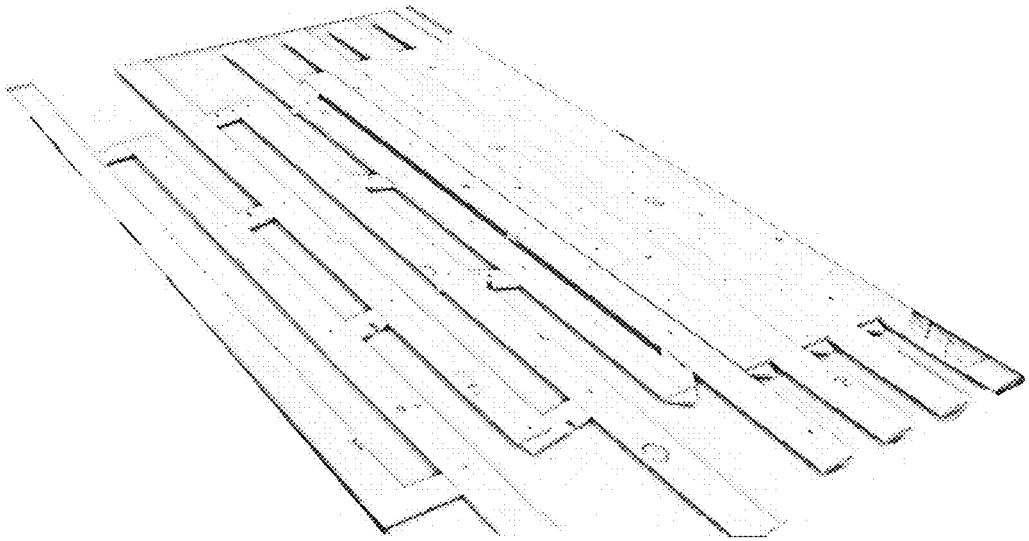
Figure 14C:
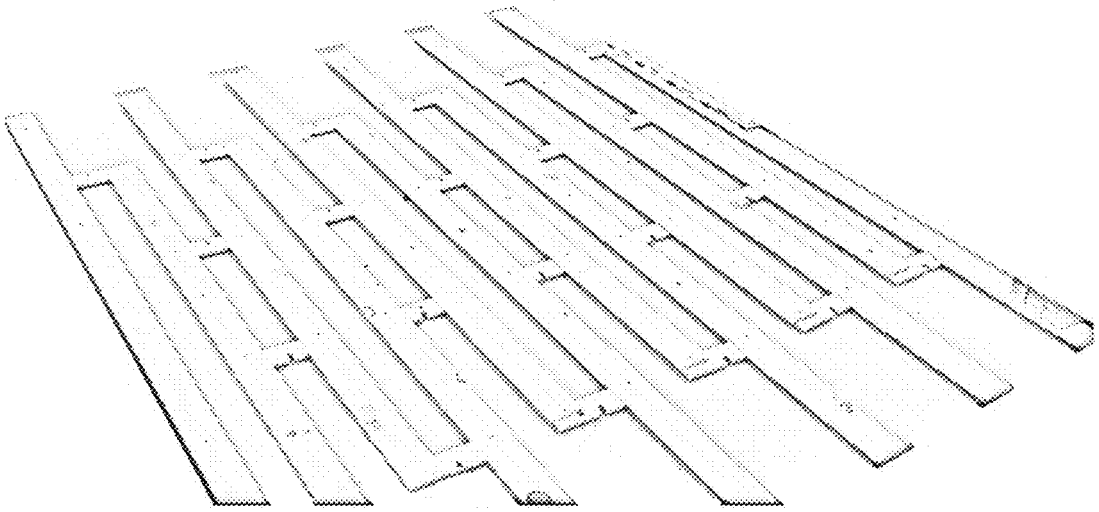

In one example, a cross-arm member 20 can be pivotally coupled to an end of a sleeper component 15 to enable an edge of the cross-arm member 20 to protrude from the end of the second sleeper component 15 when the extendable flooring module 10 is in the extended position. The edge of the cross-arm member 20 can provide support for an adjacent sleeper component included in an adjacent extendable flooring module, as shown in FIG. 14C.

FIGS. 6-7 also show that in the extended position, a floor anchor point included in a cross-arm member 20 is exposed. The floor anchor point can be a notch, hole, or other type of anchor point that is used to secure or attach the cross-arm members 20 to a ground surface.

Figure 8:
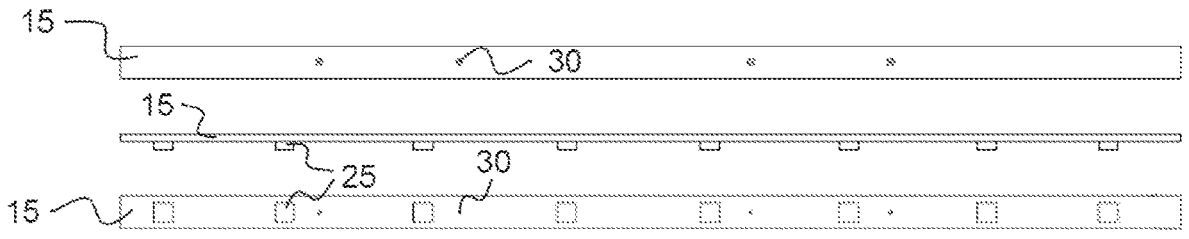
FIG. 8 includes a top, bottom, and side view of a sleeper component included in the extendable flooring module of FIG. 1 in accordance with one aspect of the technology.

FIG. 8 includes a top view, side view, and bottom view of an elongated sleeper component 15 included in the extendable flooring module 10 of FIG. 1. The sleeper component 15 is preferably made of rigid material designed to accept typical mechanical fasteners, such as wood. As a non-limiting example, the sleeper component 15 can comprise a ½ inch thick, eight inch wide by eight foot long wood plank. As shown, holes 30 extending from a top surface to a bottom surface of the sleeper component 15 can be placed at locations corresponding to cross-arm member placements. The holes 30 can accept the fasteners used to couple the cross-arm members 20 with the sleeper components 15. A number of resilient pads 25 can be placed at locations along the bottom surface of the sleeper component 15 to evenly support a load placed on the extendable flooring module 10 and to prevent contact of the cross-arm members 20 with a ground surface.

Figure 9:
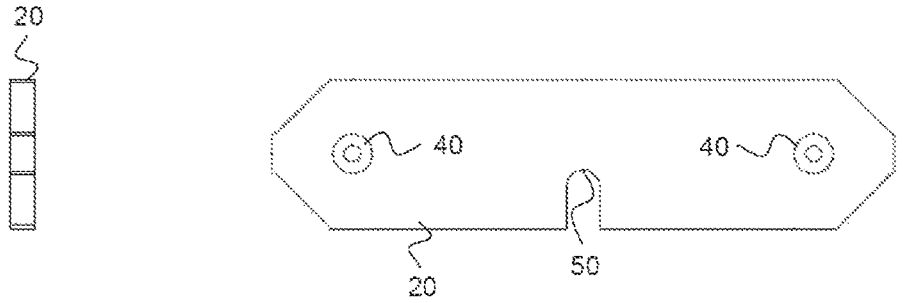
FIG. 9 is a top view and a side view of a cross-arm member included in the extendable flooring module of FIG. 1 in accordance with one aspect of the technology.
Figure 10:
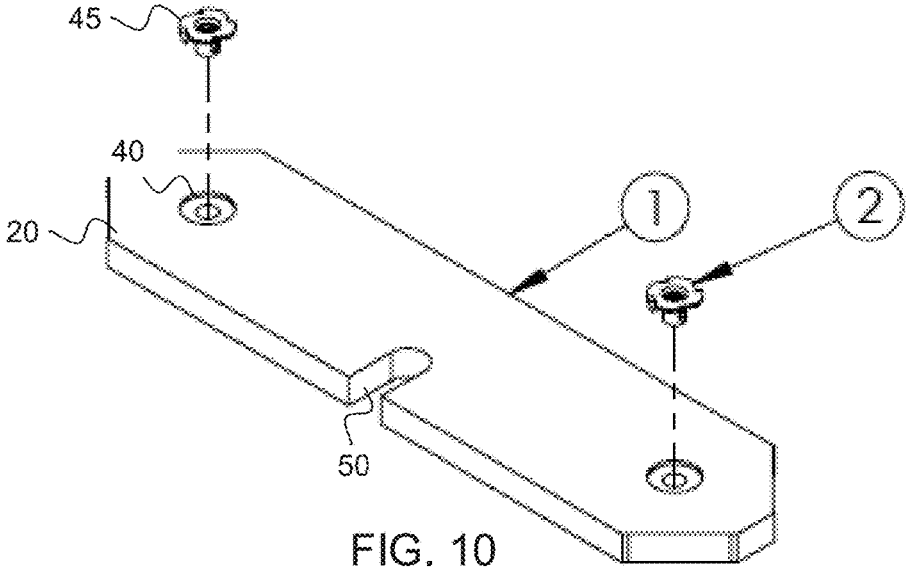
FIG. 10 is a bottom perspective view of the cross-arm member of FIG. 9.

FIG. 9 includes a top view and a side view of a cross-arm member 20 included in the extendable flooring module 10 shown in FIG. 1. As described earlier, the cross-arm member 20 is pivotally coupled with adjacent sleeper components 15 using fasteners 35 to allow the cross-arm member 20 to pivot relative to the adjacent sleeper components 15. The cross-arm member 20 has a hole 40 or opening on each distal end of the cross-arm member 20 to allow coupling of the cross-arm member to adjacent sleeper components 15. The hole 40 extends from a top surface to a bottom surface of the cross-arm member 20 and is designed to accept a fastener 35. In one example, as shown in FIG. 10, a nut or rivet tail can occupy a portion of the hole 40 to allow a fastener 35 (e.g., a threaded bolt or a rivet with a flat head on one end) to attach to the nut or rivet tail. The cross-arm member 20 can include a floor anchor point 50 disposed about opposing sides of the cross-arm member 20 in a location that is exposed when the extendable flooring module 10 is in the extended position. In FIGS. 9-10, the floor anchor point 50 is a notch. However, as will be appreciated, the floor anchor point 50 can comprise a hole, slot, or any other type of anchor point used to secure a subfloor to a ground surface.

Figure 11:
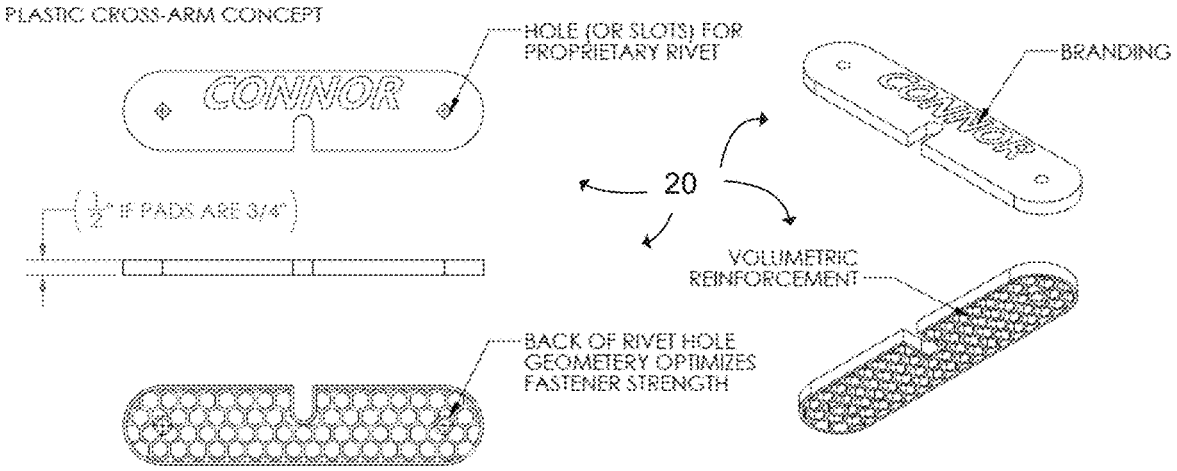
FIG. 11 includes top, bottom, and side view of a cross-arm member, and a top and bottom perspective view of the cross-arm member in accordance with one aspect of the technology.
Figure 12:
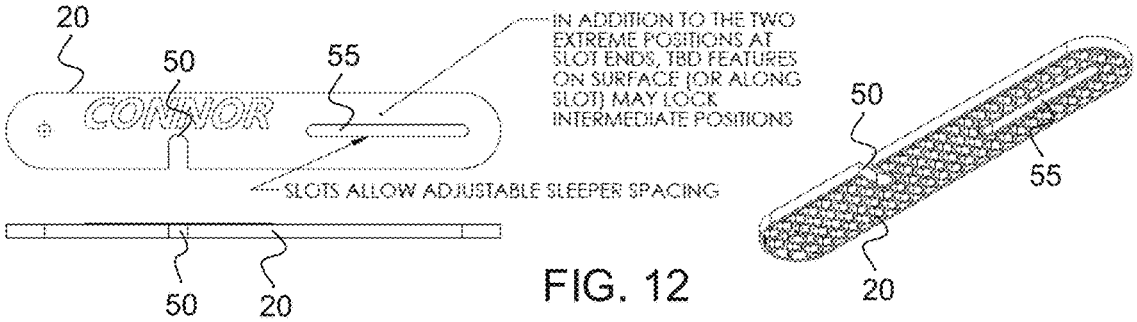
FIG. 12 includes a top and side view, and a bottom perspective view of a cross-arm member in accordance with one aspect of the technology.

The cross-arm member 20 is preferably made of rigid material designed to securely connect adjacent sleeper components 15, such as wood, rigid or semi-rigid polymer, plastic, metal alloy, rubber, or other material. In one example, as shown in FIGS. 11-12, the cross-arm member 20 can be a polymeric material, and may be formed using molding techniques known in the art such as injection molding, compression molding, and the like and are formed or molded in a single, integrated unit. The cross-arm member 20 may be approximately 15/32 inches thick, twelve inches long, and 3 inches wide. However, the dimensions of the cross-arm member 20 can be made to suit a particular design.

FIG. 12 illustrates a cross-arm member 20 that includes a slot 55 disposed about opposing sides of an end portion of the cross-arm member 20. The slot 55 has a width to accept a fastener 35 and a length to allow longitudinal movement of the fastener 35 in the slot 55. This allows adjustment of a space (shown as 40 in FIG. 6) between adjacent sleeper components. For example, after placing the extendable flooring module 10 in the extended position, such that the cross-arm members 20 are perpendicular to the sleeper components 15, the slot 55 in the cross-arm member 20 allows the cross-arm member 20 to slide the length of the slot 55 underneath the bottom surface of a sleeper component 15 coupled to the slot end of the cross-arm member 20. In one example, the slot 55 can include a plurality of grooves (not shown) for adjustment of the fastener 35 in the slot 55. The grooves provide locations for fastener placement and define predetermined distances or spaces 40 between adjacent sleeper components. The location of the grooves in the slot 55 can be based on performance parameters for a floor system. Sliding the slot end of the cross-arm 20 causes the opposing end of the cross-arm member 20 coupled to an adjacent sleeper component 15 to push or pull the adjacent sleeper component 15 and increase or decrease the space 40 between the adjacent sleeper components 15. Adjusting the space 40 between the sleeper components 15 allows fine tuning of a floor system.

Figure 13:
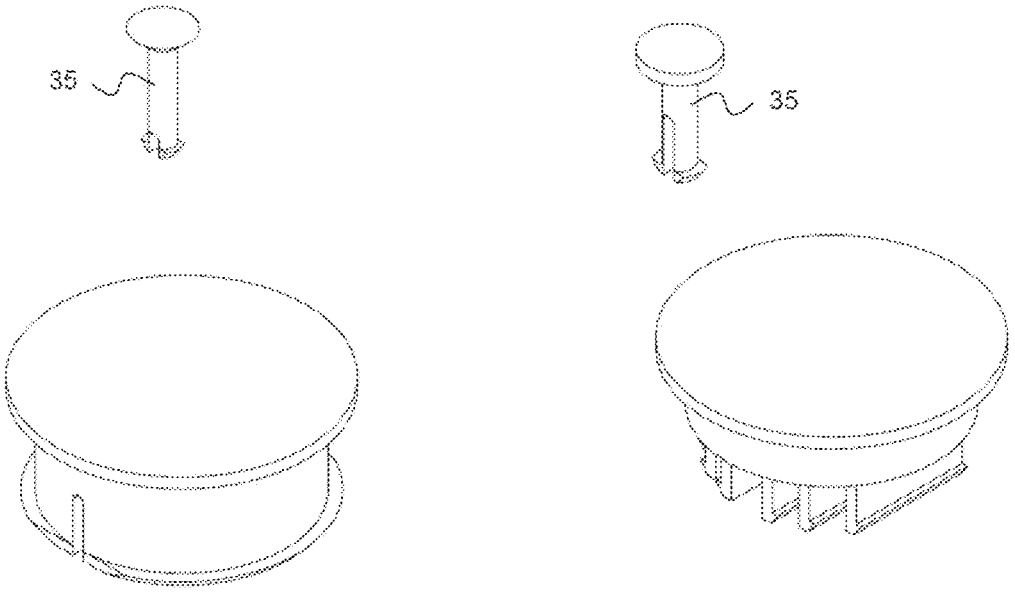
FIG. 13 are perspective views of a fastener used to couple a sleeper component and a cross-arm member.

FIG. 13 illustrate perspective views of fasteners 35 which can be used to couple a cross-arm member 20 to a sleeper component 15. In particular, a fastener 35 can include a flat head that sits flush with a top surface of sleeper component 15, and a cylindrical shaft allowing a swivel action and having a length to extend through the sleeper component 15 and operably attach to a cross-arm member 20. As shown, the fastener 35 may have an end configured to be inserted into a receiving rivet tail located in a cross-arm member 20.

Aspects of the technology are useable in a method of manufacture. Referring generally to FIG. 1, the method comprises obtaining cutting wood or another material into elongated planks comprising sleeper components 10. As a non-limiting example, ½ inch thick softwood can be cut into four inch wide by eight foot long planks. Holes 30 are made in the sleeper components 10. The location of the holes 30 correspond to positions where cross-arm members 20 will be coupled to the sleeper components 10. Cross-arm members 20 can be cut from a wood material, or can be manufactured using another method, such as injection molding.

The sleeper components 15 are placed adjacent to one another. The cross-arm members 20 are positioned on the bottom surface of the sleeper components 15, such that holes or slots in the end portions of the cross-arm members 20 are aligned with holes or slots in the sleeper components 15 used to pivotally couple the cross-arm members 20 to the sleeper components 15. Fasteners 35 are placed through the holes 30 of the sleeper components 15 so that the fasteners 35 extend from the top surface of the sleeper components 15 down into the holes in the cross-arm members 20, effectively coupling the cross-arm members 20 to the sleeper components 15. Resilient pads 25 are disposed along the bottom surface of the sleeper components 15 using an adhesive, staple, or the like.

Aspects of the technology are useable in a method of installation. Referring generally to FIG. 1 and more specifically to FIGS. 14A-C, the method comprises obtaining a first extendable flooring module 10 in a collapsed position. The extendable flooring module 10 is pre-manufactured, and as previously described, includes a plurality of sleeper components 15, cross-arm members 20, and a pivot system that allows the extendable flooring module 10 to be transitioned between a collapsed position and an extended position. Having obtained the first extendable flooring module 10 in the collapsed position, the extendable flooring module 10 is positioned to an installation location on a ground surface, as shown in FIG. 14A. The ground surface is typically a concrete layer or the like. The resilient pads 25 of the extendable flooring module 10 rests upon the ground surface. As shown in FIG. 14B, an end of the extendable flooring module 10 comprising an outward facing sleeper component 15 is pulled outward causing the cross-arm members 20 below the sleeper component 15 to pivot and extend away from the sleeper component 15. This pulling action is continued until each of the cross-arm members 20 in the extendable flooring module 10 are substantially perpendicular to the sleeper components 15, as shown in FIG. 14C. Alternatively, the extendable flooring module 10 is placed in a position that partially pivots the cross-arm members 20 to an oblique angle relative to the sleeper components 15.

After installing the first extendable flooring module 10, a second extendable flooring module in a collapsed position is obtained for adjacent placement to the first extendable flooring module, and the second extendable flooring module is placed in the extended position on the ground surface. In another example, a first and second extendable flooring module 10 in the collapsed position are positioned on a ground surface, such that the extendable flooring modules 10 are adjacent to one another. The extendable flooring modules 10 are then placed in the extended position at substantially the same time.

With reference to FIG. 15, adjacent extendable flooring modules 10 can be connected using a connector cross-arm member 60 having a first end that is pivotally coupled to an end sleeper component 65 of the extendable flooring module 10, and an uncoupled second end that is available to be pivotally coupled with an adjacent extendable flooring module. An installer can connect the uncoupled end of the connector cross-arm member 60 to an end sleeper component 65 of the second extendable flooring module. The end sleeper component 65 of the second extendable flooring module can contain predrilled holes 75 configured to accept the uncoupled end of the connector cross-arm member 60. The uncoupled end of the connector cross-arm member 60 is then connected to the second extendable flooring module using a fastener 35 and the predrilled holes in the end sleeper component 65. For installation purposes, the extendable flooring module 10 is preferably preassembled in standard lengths, such as 8 foot sections. Rows of the extendable flooring modules 10 are placed across the area to be covered and are then extended.

In one example, extending the extendable flooring module 10 exposes floor anchor points in the cross-arm members 20, and the extendable flooring module 10 can be attached to a ground surface via the floor anchor points. In another example, mechanical fasteners are not generally needed nor desired, which makes installation easier and more efficient. This is advantageous because the subfloor comprising the extendible flooring modules 10 does not require mechanical anchoring to the underlying ground surface. As a result, the subfloor is simple and cost effective to install. The ease of installation is appreciated when retrofitting the subfloor to replace an existing sports floor. The ease of installation is advanced by providing a broader base for attaching flooring boards. As a result, less time is needed for applying floor fasteners.

The foregoing detailed description describes the technology with reference to specific exemplary aspects. However, it will be appreciated that various modifications and changes can be made without departing from the scope of the present technology as set forth in the appended claims. The detailed description and accompanying drawings are to be regarded as merely illustrative, rather than as restrictive, and all such modifications, combination of features, or changes, if any, are intended to fall within the scope of the present technology as described and set forth herein. In addition, while specific features are shown or described as used in connection with particular aspects of the technology, it is understood that different features may be combined and used with different aspects. Likewise, numerous features from various aspects of the technology described herein may be combined in any number of variations as suits a particular purpose.

More specifically, while illustrative exemplary aspects of the technology have been described herein, the present technology is not limited to these aspects, but includes any and all aspects having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the technology should be determined solely by the appended claims and their legal equivalents, rather than by the descriptions and examples given above.

The invention claimed is:

1. An extendable flooring module, comprising:

at least two sleeper components, wherein a first sleeper component is positioned parallel to a second sleeper component;

at least one cross-arm member having a first end and a second end; and a pivot system comprising fasteners that couple the first end of the at least one cross-arm member to a portion of the first sleeper component and couple the second end of the at least one cross-arm member to a portion of the second sleeper component, such that each of the at least one cross-arm member couples to only a first and second sleeper component, the fasteners allowing the at least one cross-arm member to pivot relative to the first and second sleeper components and the at least one cross-arm member to span a distance between the first and second sleeper components, substantially normal to the first and second sleeper components, when the extendable flooring module is placed in an extended position;

the at least one cross-arm member contains a slot disposed about opposing sides of an end portion of the at least one cross-arm member, the slot having a width to accept at least one of the fasteners and a length to allow longitudinal movement of the at least one fastener in the slot to adjust a space between the first sleeper component and the second sleeper component.

2. The extendable flooring module of claim 1, wherein the at least one cross-arm member is disposed on a bottom surface of the first and second sleeper components.

3. The extendable flooring module of claim 1, wherein the at least one cross-arm member contains a floor anchor point disposed about opposing sides of the at least one cross-arm member and the floor anchor point is exposed when the extendable flooring module is in the extended position.

4. The extendable flooring module of claim 3, wherein the floor anchor point is a notch disposed about opposing sides of the at least one cross-arm member.

5. The extendable flooring module of claim 1, wherein the slot includes a plurality of grooves for adjustment of the at least one fastener in the slot, the grooves providing locations for the at least one fastener placement used to define predetermined distances between the first sleeper component and the second sleeper component.

6. The extendable flooring module of claim 1, wherein the fasteners are rivets having a flat head with an overhanging lip at one end, and a cylindrical shaft to extend through one of the at least two sleeper components and attach to a rivet tail located in the at least one cross-arm member.

7. The extendable flooring module of claim 1, wherein the at least one cross-arm member is pivotally coupled to an end of one of the first or second sleeper components to enable an edge of the at least one cross-arm member to protrude from the end of the first or second sleeper component when the extendable flooring module is in the extended position, the edge of the at least one cross-arm member providing support for an adjacent sleeper component included in an adjacent extendable flooring module.

8. The extendable flooring module of claim 1, wherein placement of the at least one cross-arm member on the first and second sleeper components is configured to align an end of the first sleeper component with an end of the second sleeper component when the extendable flooring module is in a collapsed position, and offset the end of the first sleeper component from the end of the second sleeper component when the extendable flooring module is in the extended position.

9. The extendable flooring module of claim 1, wherein placement of the at least one cross-arm member on the first and second sleeper components is configured to horizontally offset the first sleeper component from the second sleeper component when the extendable flooring module is in either of a collapsed position or the extended position.

10. The extendable flooring module of claim 1, further comprising at least two cross-arm members having first ends pivotally coupled to the first sleeper component and second ends pivotally coupled to the second sleeper component, and the at least two cross-arm members being spaced apart from one another to substantially maintain a right angle distance between the first and second sleeper components.

11. The extendable flooring module of claim 1, further comprising a connector cross-arm member having a first end that is pivotally coupled to an end sleeper component of the extendable flooring module, and an uncoupled second end that is available to be pivotally coupled with an adjacent extendable flooring module.

12. The extendable flooring module of claim 1, further comprising a plurality of resilient pads disposed along a bottom surface of the first and second sleeper components, wherein the plurality of resilient pads have a height which is greater than that of the at least one cross-arm member.

13. A extendable flooring system, comprising:

at least two extendable flooring modules positioned adjacent one another, each extendable flooring module comprising:

at least two sleeper components, wherein a first sleeper component is positioned parallel to a second sleeper component;

at least one cross-arm member having a first end and a second end; and a pivot system comprising fasteners that couple the first end of the at least one cross-arm member to a portion of the first sleeper component and couple the second end of the at least one cross-arm member to a portion of the second sleeper component, the fasteners allowing the at least one cross-arm member to pivot relative to the first and second sleeper components and the at least one cross-arm member to span a distance between the first and second sleeper components, the at least one cross-arm member substantially perpendicular to the first and second sleeper components, when the extendable flooring module is placed in an extended position, wherein the at least one cross-arm member is pivotally coupled to an end of one of the first or second sleeper components to enable an edge of the at least one cross-arm member to protrude from the end of the first or second sleeper component when the extendable flooring module is in the extended position, the edge of the at least one cross-arm member providing support for an adjacent sleeper component of a second extendable flooring module, wherein the at least one cross-arm member contains a slot disposed about opposing sides of an end portion of the at least one cross-arm member, the slot having a width to accept at least one of the fasteners and a length to allow longitudinal movement of the at least one fastener in the slot to adjust a space between the first sleeper component and the second sleeper component.

14. The extendable flooring system of claim 13, wherein the at least one cross-arm member is disposed on a bottom surface of the first and second sleeper components.

15. The extendable flooring system of claim 13, wherein the at least one cross-arm member contains a floor anchor point disposed about opposing sides of the at least one cross-arm member and the floor anchor point is exposed when the extendable flooring module is in the extended position.

16. The extendable flooring system of claim 13, further comprising a plurality of resilient pads disposed along a bottom surface of the first and second sleeper components, wherein the plurality of resilient pads have a height which is greater than that of the at least one cross-arm member.

17. The extendable flooring system of claim 13, wherein the extendable flooring module is configured to offset the first sleeper component from the second sleeper component when the extendable flooring module is in the extended position.

18. A method of installing a sub-floor using a plurality of extendable flooring modules, comprising:

(a) obtaining a first extendable flooring module in a collapsed position, wherein each of the plurality of extendable flooring modules includes:

(i) at least two sleeper components, wherein a first sleeper component is positioned parallel to a second sleeper component;

(ii) at least one cross-arm member having a first end and a second end;

(iii) a pivot system comprising fasteners that couple the first end of the at least one cross-arm member to a portion of the first sleeper component and couple the second end of the at least one cross-arm member to a portion of the second sleeper component, the fasteners allowing the at least one cross-arm member to pivot relative to the first and second sleeper components and the at least one cross-arm member to span a distance between the first and second sleeper components when an extendable flooring module is placed in an extended position; and (iv) the at least one cross-arm member contains a slot disposed about opposing sides of an end portion of the at least one cross-arm member. the slot having a width to accept at least one of the fasteners and a length to allow longitudinal movement of the at least one fastener in the slot to adjust a space between the first sleeper component and the second sleeper component;

(b) positioning the first extendable flooring module which is in the collapsed position on a ground surface; and (c) placing the first extendable flooring module in the extended position on the ground surface.

19. The method of claim 18, wherein placing the extendable flooring module in the extended position pivots the at least one cross-arm member to be perpendicular to the first and second sleeper components.

20. The method of claim 18, wherein placing the extendable flooring module in the extended position further comprises partially pivoting the at least one cross-arm member to an oblique angle relative to the first and second sleeper components.

21. The method of claim 18, wherein an oblique angle of the at least one cross-arm member exposes a floor anchor point disposed about opposing sides of the at least one cross-arm member.

22. The method of claim 18, further comprising attaching the first extendable flooring module to the ground surface.

23. The method of claim 18, further comprising:

obtaining a second extendable flooring module in a collapsed position for adjacent placement to the first extendable flooring module; and placing the first and second extendable flooring modules in the extended position on the ground surface.

24. The method of claim 18, further comprising:

obtaining a second extendable flooring module for adjacent placement to the first extendable flooring module; and connecting an uncoupled end of a connector cross-arm member pivotally coupled to an end sleeper component of the first extendable flooring module to an adjacent end sleeper component of the second extendable flooring module.

* * * * *